United States Patent [19]

Sato et al.

[11] Patent Number: 4,681,026

[45] Date of Patent: Jul. 21, 1987

[54] SPRAY COATING CHAMBER FREE FROM PAINTING MIST LEAKAGE

[75] Inventors: Akira Sato, Ibaragi; Fumio Maki, Kitakyushu, both of Japan

[73] Assignee: Parker Arrester Co., Ltd., Tokyo, Japan

[21] Appl. No.: 883,410

[22] Filed: Jul. 8, 1986

[30] Foreign Application Priority Data

Jul. 30, 1985 [JP] Japan ..... 60-166901

[51] Int. Cl.[4] ..... B05B 15/12

[52] U.S. Cl. ..... 98/115.2; 98/36; 118/326; 118/DIG. 7

[58] Field of Search ..... 98/115.2, 36; 118/326, 118/DIG. 7

[56] References Cited

U.S. PATENT DOCUMENTS 4,241,646 12/1980 Tsurata et al. ..... 118/DIG. 7 X
4,338,364 7/1982 Kennon et al. ..... 98/115.2 X
4,545,324 10/1985 Browning ..... 98/115.2 X
4,607,592 8/1986 Richter ..... 98/115.2 X

FOREIGN PATENT DOCUMENTS 64145 4/1985 Japan ..... 98/36
2026683 2/1980 United Kingdom ..... 118/326

*Primary Examiner*—Albert J. Makay
*Assistant Examiner*—Steven E. Warner
*Attorney, Agent, or Firm*—Armstrong, Nikaido, Marmelstein & Kubovcik

[57] ABSTRACT

A spray coating equipment or chamber system consists of a single paint spray chamber at the axial central part of the equipment, a plurality of intermediate air curtain compartments at the axial outer sides and a pair of outermost air curtain compartments, one at each axial end of the spray coating chamber. Discharge ducts in each air-curtain compartment are disposed toward each other and normal to the axis line of the painting equipment and each duct is positioned being spaced apart from both side walls and rear wall defining the compartment at a distance 0.7 times the radius of the duct thereby the flow of air not only in the compartment but also in the entire painting equipment is rendered smooth with minimum turbulent flow and thus the equipment can be rendered free from contamination of the air in vicinity and prevent the compartment from deposition of paint particles.

4 Claims, 5 Drawing Figures

SPRAY COATING CHAMBER FREE FROM PAINTING MIST LEAKAGE

BACKGROUND OF THE INVENTION

1. Field of the Invention

This invention relates to a spray coating chamber for painting, and more particularly, it relates to a spray coating chamber free from leakage of paint mist, that is, capable of sealing therein paint mist during its painting operation. The system comprises a paint spray chamber at its middle portion between two adjacent air-curtain compartments at two opposite longitudinal sides of the chamber, wherein the contaminated air in the paint spray chamber containing floating paint mist is sucked out and the major part of such paint mist is forcibly circulated in a system of the spray coating chamber to constitute a closed circuit.

2. Description of the Prior Art

In the prior art painting chambers, there is one in which two opposite longitudinal ends are opened to constitute two openings each used for both an inlet for transferring therein works to be painted and an outlet for discharging the works painted, in which it has been inevitable that a part of the paint applied therein to the works is atomized to form a mist of air containing such atomized paint and is liable to float and circulate in the chamber, and finally it is liable to leak outside the chamber being carried by air currents in the room.

Meanwhile, it is preferred to make the particle size in the mist as small as possible in order to keep the painted film satisfactorily uniform. For this purpose of minimizing the particle size, it becomes natural to strengthen the jet force of the paint injected from the paint nozzle.

Such high speed jet of paint results in strong turbulent flow in a paint spray chamber which gives rise to undesired paint mist leakage.

In several closed loop painting systems for obviating leakage of paint mist outside, a painting chamber has been adopted, wherein only the cleaned air is circulated in the system without any leakage of harmful matter outside the system, while the air containing floating paint mist which had not been adhered to the work or works to be painted, namely, such air containing oversprayed mist is separated from such excessively sprayed paint. An example of such a system is a spray coating equipment disclosed in Japanese Utility-Model Application No. Sho 56 (1981)-26084, a prior invention by the inventor of the present invention.

The above-mentioned apparatus is constructed, in general, as shown in FIG. 1. That is, the apparatus comprises a paint spray chamber 1 located at its central portion and two static pressure compartments 2 adjacent to both axially outer sides thereof, and it further comprises a pair of air curtain compartments 3 each of which is placed adjacent to the static pressure compartment and at both axially outermost ends.

Incorporated within the paint spray chamber 1, are a paint air separator 4 for separating and catching the paint mist and a circulating fan 6 for sucking out, through a suction duct 5, the air from which the paint mist has been separated. When a part of the air in the circulating fan 6 is introduced into the static pressure compartment 2, air current flowing from the static pressure compartment 2 to the paint spray chamber 1 can be generated.

The remaining portion of the exhausted air from the circulating fan 6 is introduced to the discharge port 7 of the air curtain, while the air sucked by an air curtain suction port 8, disposed opposite to the discharge port 7, is discharged by an exhaust fan 9. By setting the amount of air sucked through the circulating fan 6 larger than that supplied from the static pressure compartments 2, a part of the discharged air from the discharge port 7 of the air curtain compartment 3 is sucked into the paint spray chamber 1 through the static pressure compartments 2. In addition, if the amount of air sucked out by the exhaust fan 9 is set larger than that of the air discharged from the air curtain discharge port 7, some amount of the air outside the system flows into the system to maintain a balance with respect to the amount. Accordingly, a major part of the air in the spray coating chamber of the equipment recirculates in the system to constitute a closed circuit and only a part of the air is expelled out being mixed with and diluted by the air outside the system.

However, in the air curtain compartment 3, discharged flow of the air curtain is liable to be increased in quantity, as it proceeds on further, by way of entrapping the air in its vicinity. Since the amount of air thus entrapped includes both the air outside the equipment and that inside, the air in the paint spray chamber 1 includes spray mist which gives rise to the flow of air curtain including mist of paint, however small in quantity the entrapped mist may be. Therefore, there has been a problem that the air curtain compartment was eventually contaminated after it was operated for a certain period of time.

There is also another type of system which is also disclosed by the present inventor and bears Japanese Utility Model Application No. 59 (1984)-04231, under the title of "A Spray Coating Chamber for Sealing Paint Mist", which improved the aforesaid apparatus of Japanese Utility Model application No. 56-26084.

The improved apparatus mentioned above has a construction substantially the same as shown in FIG. 2. That is, it also comprises a paint spray chamber placed at the center and a pair of static pressure compartments at its axially outer adjacent sides and a pair of air curtain compartments each being disposed at the adjacent outermost axial ends of the apparatus the same as shown in FIG. 1. However, the static pressure compartment 2 has been modified to further include an additional discharge port 10 so that the paint mist in the paint spray chamber cannot be entrapped into the flow of curtain air in the air curtain compartment 3.

According to the apparatus of this improved type, the flow of the air from the discharge port 10 and the flow from the discharge port 7 to the suction port 8 in the air curtain compartment 3, generally follows the path as shown in FIG. 3. However, due to the fact that there is provided only a single static pressure compartment 2 in each of the two outer parts of the paint spray chamber 1, a small amount of air mist, though it may be very little, may sometimes be entrapped into the current of curtain flow in the air curtain compartment 3. That is, the flow of air curtain from the discharge port 7 may suck out a small amount of pair mist in the paint spray chamber 1 when it proceeds while increasing the amount of air by entrapping the air in its vicinity. In such an instance, the function of the air curtain is impaired and thus results in leakage of paint mist giving rise to the contamination of the air curtain compartment. In addition, depending upon the size of the discharge port 10 in the static pressure chamber 2 and the position where it is disposed, it was found that adhering of the paint mist on the surface of surrounding walls placed at both sides and to the rearward of each discharge port was inevitable.

SUMMARY OF THE INVENTION

This invention aims to obviate the aforesaid drawbacks encountered in the conventional closed loop type spray coating equipment, so that the paint mist can be recovered from the air containing paint mist in a spray coating chamber and clean air can be sucked out and added thereto so as to be returned to the spray chamber, thereby the major part of the air in the spray coating chamber or equipment can be closed in the system.

As a means for solving the problem, static pressure compartments of the prior art system disposed adjacent to and at both longitudinal outer sides of the paint spray chamber were eliminated. Instead, two or more air curtain compartments are disposed at each of both of the axially outer sides of the spray chamber. In addition, outer ends of these compartments together constitute on opening which acts as a passage for transferring works to be painted, that is, the outermost air curtain compartment has at its central part an opening, and the space from the opening, passing through a plurality of intermediate air curtain compartments and up to the paint spray chamber, forms a passage.

Among the air curtain compartments two or more in number at one side, the outermost one at each side has a discharge duct and a suction duct each being disposed at both opposing transverse ends and facing each other. A plurality of intermediate air curtain compartments are provided on each axial side to strengthen or supplement the function of the outermost air curtain compartment. Within each of these intermediate air curtain compartments, there are disposed a pair of discharge ducts directed toward each other and normal to the center line of the spray coating equipment.

The feature of the present invention different from prior art equipment resides in the point as explained below.

According to the conventional system, discharge ducts in each air curtain compartment were closely adjacent to the wall rearward of the duct so that there arises no flow of air current around the rear part of the duct. The present invention, on the contrary, positively forms a passage of air flow passing through and around both the side faces and rear face of the duct, by setting the spacing from the outer surface of the duct to the two side walls also to the rear wall which define each air curtain compartment, to be larger than 0.7 times the radius of the duct cylinder, and thereby allows the air in the compartment to flow smoothly from one side of the air curtain, through its rear spacing, to the other side of the compartment.

DETAILED DESCRIPTION OF THE PREFERRED EMBODIMENT

Explanation will now be made by referring to FIGS. 4 and 5 of the accompanying drawings, of the spray coating equipment capable of sealing and preventing paint mist from floating in the room in accordance with the preferred embodiment of the present invention.

Figure 1:
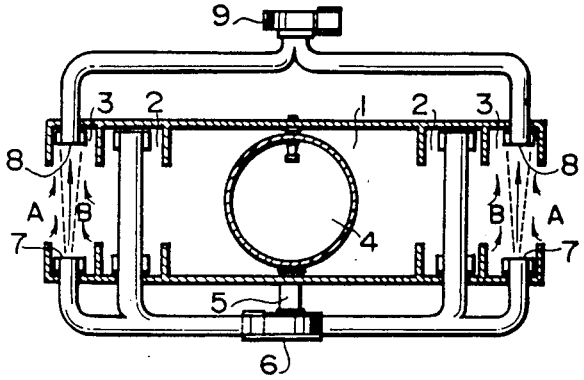
FIG. 1 PRIOR ART
FIGS. 1 and 2 are plan views each showing a conventional spray coating chamber.
Figure 2:
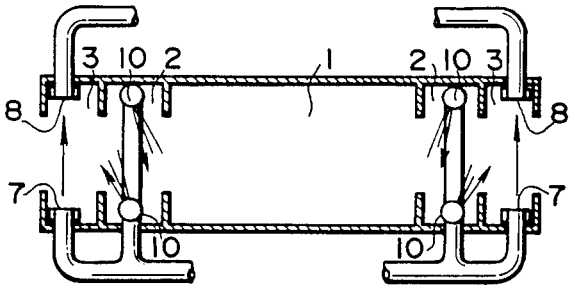
FIG. 2 PRIOR ART
Figure 3:
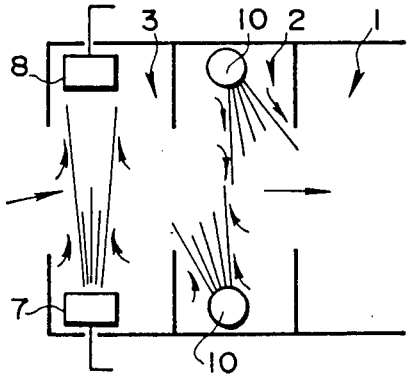
FIG. 3 PRIOR ART
FIG. 3 is an enlarged plan view showing an axial end portion of the spray coating chamber shown in FIG. 2.
Figure 4:
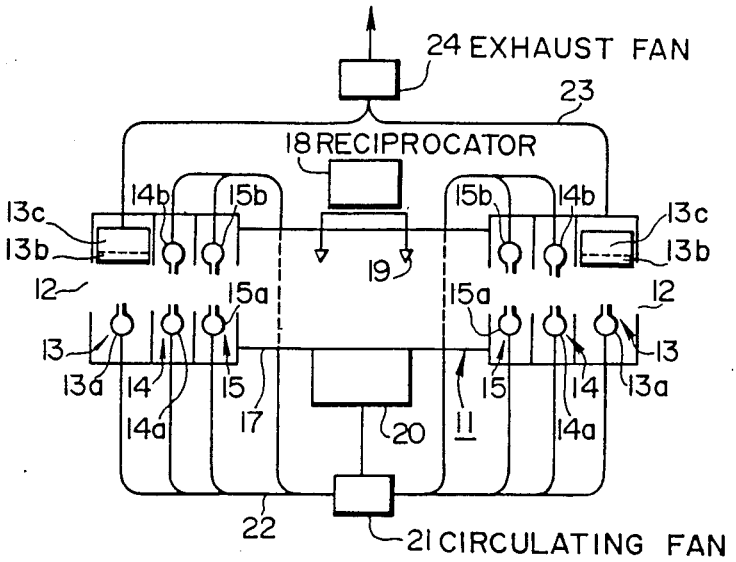
FIG. 4 is a sectional plan view of a spray coating chamber capable of sealing floating paint mist according to an embodiment of the present invention.

The spray coating equipment or chamber 11 comprises, as shown in FIG. 4, a paint spray chamber 17 disposed within and at the middle portion of the spray coating equipment, and two openings 12, one at each of the axial ends. Disposed inside each of the openings 12 is an outer air curtain compartment 13 at the outermost axial end of the equipment and two intermediate air curtain compartments 14 and 15 interposed between the paint spray chamber 17 and the outer air curtain compartment 13. The interior of the outer air curtain compartment 13 is provided, at both transverse sides sandwiching the work transferring passage, with a discharge duct **13*a* at one side, that is, an air discharge side, and an air filter 13*b* and a suction duct 13*c* at the other side, namely, the air arrival side. The interiors of the intermediate air curtain compartment 14 and 15 are provided with a pair of opposedly directed discharge ducts 14*a*, 14*b* and 15*a*, 15*b*, respectively. In addition, each of these discharge ducts 13*a*, 14*a*, 14*b*, 15*a*, 15*b* in these air curtain compartments 13, 14 and 15** are formed to have a cylindrical shape and are rotatable around each axis so as to be adjusted for free change in their air discharge direction.

Figure 5:
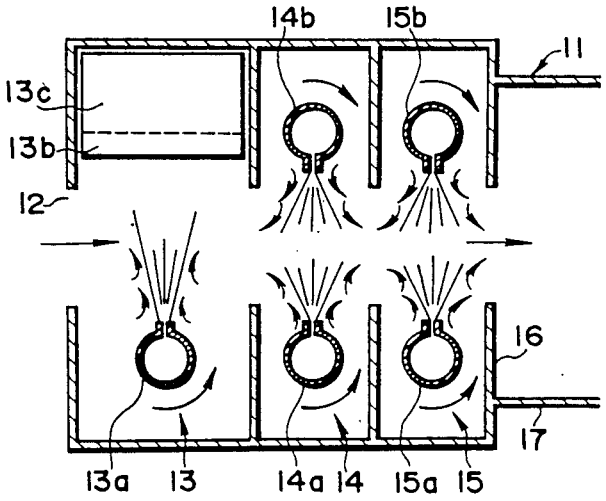
FIG. 5 is an enlarged plan view showing an axial end portion of the paint spray chamber shown in FIG. 4.

Moreover, these discharge ducts are disposed as shown in FIG. 5, such that each of them is spaced apart from the compartment walls 16 surrounding the two transverse sides and the rear part of each duct at a distance more than 0.7 times the radius of the cylindrical discharge duct in order that the air flow around the duct may not be disturbed.

Within the paint spray chamber 17 at the middle part of the spray coating chamber 11, a pair of spray guns 19 carried by a reciprocator 18 are disposed and are capable of being freely raised or lowered. In addition, there is also disposed a paint-air separating means 20 provided with a circulating fan 21, the discharge side of which is connected via an air circulating duct 22 to each discharge duct **13*a*, 14*a*, 14*b*, 15*a* and 15*b* of each air curtain compartment, 13, 14 and 15. The suction duct 13*c* is connected via an exhaust dust 23 to exhaust fan 24**.

Painting operation of this equipment will be explained hereafter.

Air in the paint spray chamber 17 is sucked via the paint-air separator. 20 by the circulating fan 21, the exhaust air of which is passed through the air circulating duct 22 and is returned to the discharge duct of each air-curtain compartment and the major part of the exhaust air is sent back again to the paint spray chamber 17, while a minor part of the air circulating in the system is sucked in by the suction duct **13*c*, passing through the exhaust duct 23 and is discharged outside by the exhaust fan 24**.

By spraying the paint in the paint spray chamber 17 by starting the spray gun 19, the paint is atomized to fill the entire interior of the paint spray chamber 17 with paint mist floating in the air. Sucking out of such air in the chamber by the circulating fan 21, renders a part of the cleaned air from which the contained paint mist has been removed by the paint-air separating means 20, to be discharged from the discharge duct **13*a* in the outer air curtain compartment 13. The air discharged from the discharge duct 13***a* proceeds on, while entrapping the air in the adjacent atmosphere and increasing the amount thereof as shown in FIG. 5, by following a curved path being affected by the side wind, and proceeds further while taking up the air coming from both outside through the opening 12 and that coming from inside the central part of the chamber, finally it reaches to the air filter 13*b* and is discharged outside. In this way, the air flow in the outer air curtain compartment 13 blocks the air in the spray coating chamber 13 from leaking out.

However, since the outermost air curtain compartment 13 alone is not sufficient enough in force to withstand the side wind caused by the pressure difference or by the turbulent flow generated within or outside the spray coating chamber, the intermediate air curtain compartments 14 and 15 are provided to supplement such storage of force. The remainder of the air discharged from the circulating fan 21 is supplied to the pairs of discharged ducts 14*a*, 14*b* and 15*a*, 15*b*. The discharge air from these ducts also advances by entrapping the air from both the opening and the central part of the chamber to prevent the air in the chamber from leaking outside. In addition, since the discharge ducts in each air curtain compartment, 13*a*, 14*a*, 14*b*, 15*a* and 15*b* are made rotatable and are disposed so as to be spaced apart from the walls surrounding each duct at a distance more than 0.7 times the radius of the duct cylinder, the suctioned air forming the air curtain is forced to flow by passing through the space defined between the cylindrical duct and the surrounding walls, thereby the thus supplied air will never disturb the air flow in the air curtain compartment and any leakage of the paint mist will effectively be prevented from occurring. In addition, if the direction of the air flow is changed by increasing the inclination angle directed toward the central part of the chamber depending on the extent of the side wind, the effect for preventing leakage of the paint mist will further be improved.

MERITORIOUS EFFECT OF THE INVENTION

Having been constructed as expleined above, air curtain flow in the entire spray coating chamber in accordance with the present invention can be made free from any paint mist leakage. Accordingly, the outermost air curtain compartment can be completely prevented from contamination by leaked-out paint mist.

We claim:

1. A spray coating chamber system free from leakage of paint mist floating within a pair spray chamber, which comprises, a paint spray chamber at the axially middle part of the chamber system and a plurality of air curtain compartments disposed at each axial outer side of said paint spray chamber, wherein said plurality of air curtain compartments comprises;

a pair of outermost air curtain compartments one of each being disposed at each outermost axial end and each being directed normal to said axis line and having at least one discharge duct at one transverse side and at least one suction duct at the other transverse side thereof;

at least one intermediate air curtain compartment disposed at each axial outer side of said spray coating chamber and having at least a pair of discharge ducts directed toward each other and normal to said axis line;

the region of the spray coating chamber starting from said paint spray chamber, passing through said intermediate air curtain compartment and said outermost air curtain compartment and up to the outlet opening constituting a passage for transferring the works to be painted;

each discharge duct in each air curtain compartment being spaced apart at a distance from the two side walls and rear wall surrounding said duct such that the air in said compartment can freely flow in the channels defined between said duct and said side walls and said rear wall; whereby the air in the paint spray chamber can be returned to the discharge duct or ducts of each air curtain compartment and circulated after having been separated into air and paint particles by a separating means.

2. A spray coating chamber system as claimed in claim 1, wherein said at least one intermediate air curtain compartment is disposed in a plurality of pairs at each of both axial sides.

3. A spray coating chamber system as claimed in claim 1 or 2, wherein each of said discharge ducts is spaced apart from said side walls and said rear wall surrounding said duct at a distance more than 0.7 times the radius of the duct.

4. A spray coating chamber system as claimed in claim 1 or 2 wherein said discharge ducts have a cylindrical configuration and are rotatable around their vertical axes so that their discharge angle can be adjusted in a horizontal direction.

* * * * *